US010246664B1

(12) United States Patent
Wisecarver et al.

(10) Patent No.: US 10,246,664 B1
(45) Date of Patent: Apr. 2, 2019

(54) CLEANING SOLUTION

(71) Applicants: Mike Wisecarver, New Orleans, LA (US); Ligia Hernandez, New Orleans, LA (US)

(72) Inventors: Mike Wisecarver, New Orleans, LA (US); Ligia Hernandez, New Orleans, LA (US)

( * ) Notice: Subject to any disclaimer, the term of this patent is extended or adjusted under 35 U.S.C. 154(b) by 0 days.

(21) Appl. No.: 15/610,386

(22) Filed: May 31, 2017

Related U.S. Application Data

(60) Provisional application No. 62/344,204, filed on Jun. 1, 2016.

(51) Int. Cl.

| | |
|---|---|
| ***C11D 1/12*** | (2006.01) |
| ***C11D 3/04*** | (2006.01) |
| ***C11D 3/22*** | (2006.01) |
| ***C11D 3/33*** | (2006.01) |
| ***C11D 3/395*** | (2006.01) |
| ***C11D 3/43*** | (2006.01) |
| ***C11D 1/66*** | (2006.01) |
| ***C11D 3/12*** | (2006.01) |
| ***C11D 3/20*** | (2006.01) |
| ***C11D 3/40*** | (2006.01) |

(52) U.S. Cl.
CPC ..... *C11D 1/662* (2013.01); *C11D 1/12* (2013.01); *C11D 3/04* (2013.01); *C11D 3/1246* (2013.01); *C11D 3/2068* (2013.01); *C11D 3/2086* (2013.01); *C11D 3/222* (2013.01); *C11D 3/33* (2013.01); *C11D 3/40* (2013.01); *C11D 3/43* (2013.01)

(58) Field of Classification Search
CPC .. C11D 1/12; C11D 1/662; C11D 3/04; C11D 3/1246; C11D 3/22; C11D 3/222; C11D 3/33; C11D 3/395; C11D 3/43
See application file for complete search history.

(56) References Cited

U.S. PATENT DOCUMENTS

2010/0317559 A1* 12/2010 Ryther ..... C11D 3/044 510/218

* cited by examiner

*Primary Examiner* — Brian P Mruk
(74) *Attorney, Agent, or Firm* — Andrew G. Vicknair

(57) ABSTRACT

A cleaning solution and method of manufacturing a cleaning solution is set forth herein whereby the cleaning solution is environmentally friendly and meets direct release requirements so that the cleaning solution may be directly released into the environment. In one preferred embodiment, the cleaning solution includes water; a thickener; hydrogen peroxide ($H_2O_2$) a surfactant; and a pH adjuster.

13 Claims, 3 Drawing Sheets

CLEANING SOLUTION

CROSS REFERENCE TO RELATED APPLICATIONS

This application claims the benefit of U.S. provisional patent application Ser. No. 63/344,204 filed on Jun. 1, 2016.

TECHNICAL FIELD

The present invention relates, in general to a cleaning solution and methods of manufacturing the cleaning solutions, and more specifically to a direct release environmentally-friendly cleaning solution that can be utilized and directly released into the environment, including, but not limited to, land and various aquatic environments, including lakes, oceans, rivers, and streams.

BACKGROUND OF INVENTION

Currently, chemicals used for various industries and for various purposes, including, but not limited to, the cleaning industry and chemicals and cleaners used as cleaning agents are harmful to the environment if such chemicals are directly released into the environment. In recent times, there has been a huge movement for chemicals, such as cleaners, to be reformulated in order to meet certain standards established by the Environmental Protection Agency (EPA) and the EPA's Safer Choice Standards.

Green Chemistry has also emerged with its push to inspire chemists, engineers, and other professionals to create and design various chemicals and products, including, but not limited to, cleaning solutions, to avoid the creation of toxics and waste. The use of earth-friendly products has also been stressed along with a push to create alternatives to hazardous substances that have historically been used as source materials to many chemical products. Additionally, there are various restrictions and regulations in existence that govern what types of chemical products, such as cleaning solutions, surfactants, solvents, etc., can be utilized and contained in direct release products that are designed for and intended for use in applications that result in the immediate release into the environment. With a direct release of various chemicals into the environment, these products bypass sewerage treatment and/or septic systems. Thus, it is important that such direct release products are environmentally friendly. Further, many regulations are in existence that govern and control these direct release products including, but not limited to, the EPA's Safer Choice Standards.

Many products used outdoors ultimately bypass sewerage treatment and/or septic systems and are thus considered direct release products. While such products are not always environmentally friendly, users unfortunately use these products as direct release products and simply disregard any rules and regulations concerning which products are actually approved for use as a direct release product and also disregard the consequences such products may have on the environment when used as a direct release product. In addition, many products utilized outdoors, such as cleaners, that are also used in a direct release manner do not meet the stringent safety and environmentally friendly standards in existence for such direct release products.

Accordingly, a need exists in the art for safer direct release cleaning solutions and products that can be used outdoors as a direct release product that will meet the safe and environmentally friendly standards currently in existence by the EPA and other regulatory and governing bodies.

BRIEF SUMMARY OF THE INVENTION

The present invention is directed to a cleaning solution and method for manufacturing the cleaning solution so that the cleaning solution can be used as a direct release product. Use of the cleaning solution as a direct release product will likely result in the immediate release of the cleaning solution into the environment and bypassing sewerage treatment and/or septic systems. Thus, the cleaning solution must have little effect on the environment and comply with various standards established by the EPA, such as the EPA's Safer Choice Standard direct release requirements.

According to one embodiment of the present invention, the cleaning solution may include at least highly purified or deionized water, a thickener, hydrogen peroxide ($H_2O_2$), surfactants, and a sodium metasilicate. In another embodiment, the cleaning solution may include at least highly purified or deionized water, a thickener, citric acid, a surfactant, and a chelating agent. Other embodiments may include at least highly purified or deionized water, a solvent, a surfactant, a chelating agent, citric acid, and sodium metasilicate. In other embodiments, the present invention may also include a dye for adding color to the cleaning solution. The cleaning solution may be configured in a diluted form that is ready to use and may also be configured in a concentrated form.

One method for making the cleaning solution may include the steps of (1) supplying highly purified or deionized water; (2) supplying a thickener and mixing the thickener with the highly purified or deionized water until the thickener is dissolved; (3) supplying hydrogen peroxide ($H_2O_2$); (4) supplying a surfactant (5) supplying a pH adjuster; and (6) mixing the various ingredients.

Another method for making the cleaning solution may include the steps of (1) supplying highly purified or deionized water; (2) supplying a thickener and then mixing the thickener with the highly purified or deionized water until the thickener is dissolved in the highly purified or deionized water; (3) supplying a surfactant; (4) supplying a chelating agent; (5) mixing the various ingredients; (6) checking the pH of the mixed ingredients; and (7) adjusting the pH to obtain a desired pH by adding citric acid.

Another embodiment for making the cleaning solution may include the steps of (1) supplying highly purified or deionized water; (2) supplying a solvent and then mixing the solvent with the highly purified or deionized water; (3) supplying a surfactant; (4) mixing the various ingredients; (5) checking the pH of the mixed ingredients; (6) supplying a pH adjuster; and (7) adding citric acid and mixing all ingredients.

The foregoing has outlined rather broadly the features and technical advantages of the present invention in order that the detailed description of the invention that follows may be better understood. Additional features and advantages of the invention will be described hereinafter, which form the subject of the invention. It should be appreciated that the conception and specific embodiment disclosed may be readily utilized as a basis for modifying or designing other structures for carrying out the same purposes of the present invention. It should also be realized that such equivalent constructions do not depart from the invention. The novel features which are believed to be characteristic of the invention, both as to its organization and method of operation, together with further objects and advantages will be better understood from the following description when considered in connection with the accompanying figure(s). It is to be expressly understood, however, that each of the figure(s) is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
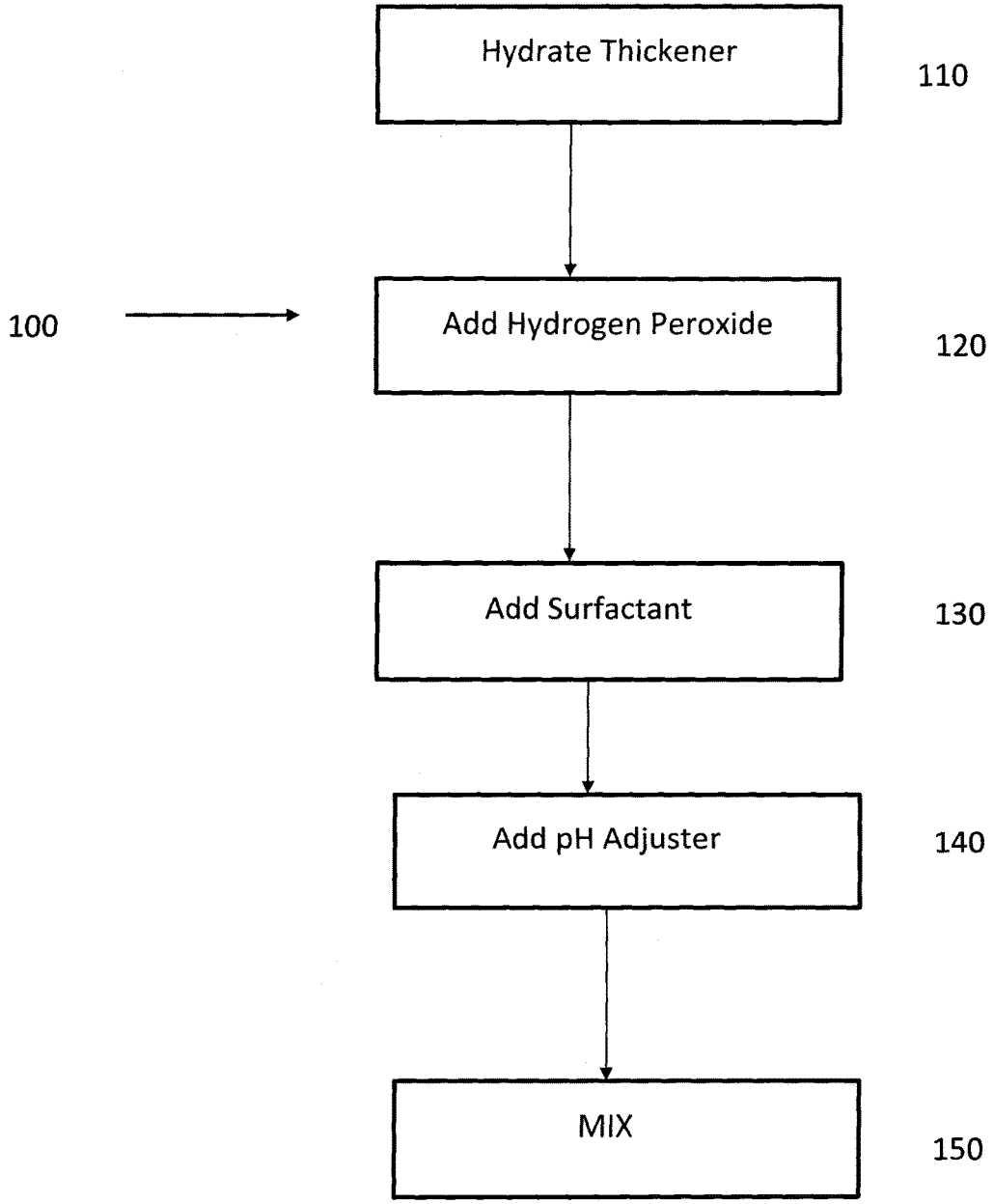
FIG. 1 is an illustration of a flowchart overview of a method of making the cleaning solution according to one embodiment of the present invention.

The present invention is directed to a cleaning solution and method for manufacturing the cleaning solution. The cleaning solution can be used as a direct release product in such a manner that will result in the immediate release of the cleaning solution into the environment and bypassing sewerage treatment and/or septic systems. As a direct release product, there is a shortened time for degradation of the cleaning solution prior to entering sensitive environments, and the cleaning solution will have little effect on the environment and will comply with various standards established by the EPA, such as the EPA's Safer Choice Standard direct release requirements.

Throughout this application, referring to a particular component or ingredient of the cleaning solution by percent weight shall mean the percentage by weight, relative to the weight of the total solution, unless stated differently.

The cleaning solution may be used on any number of items to be cleaned, including, but not limited to, items that are to be cleaned on land and/or aquatic environments. Primarily, the cleaning solution may be used primarily for various marine and aquatic devices that are constantly in and out of water, such as boats, vessels, jet skis and other items. The cleaning solution may be applied directly to these devices and released directly into various aquatic environments, such as oceans, seas, lakes, rivers, creeks, ponds, ditches and any waterways, as well as dry land, when the collection of wash-water is impractical or simply unachievable. In addition, the cleaning solution is safer for various aquatic life such as fish, shrimp, crabs, oysters, mollusks, clams, crustaceans, mammals and plant life. If the present invention were used to clean the exterior of a boat, such as a boat hull, the cleaning solution may run-off, be washed off, or directly released into the aquatic environment near the boat. For instance, a boat may be lifted on a boat lift above the aquatic environment, and the cleaning solution may be used to clean the boat with the cleaning solution running directly off of the boat or washed directly off of the boat and directly into the aquatic environment. Such use is acceptable as the cleaning solution meets the standards of the EPA's Safer Choice direct release requirements designed for use in a direct release manner.

As the cleaning solution is to be utilized as a direct release cleaner and will meet various direct release standards and regulations, the cleaning solution may also be configured to meet various aquatic toxicity regulations and standards. In a preferred embodiment, the cleaning solution will comply with the aquatic toxicity regulations established by the EPA's Safer Choice Standard direct release requirements for direct release products. In one embodiment, the cleaning solution may be configured to meet the two aquatic toxicity requirements set forth in the table below:

| | Acute Aquatic Toxicity Value (L/E/IC50) | Chronic Aquatic Toxicity Value (LOEC)[1] | Persistence (measured in terms of rate of biodegradation) | Bioaccumulation Potential |
|---|---|---|---|---|
| 1 | If acute aquatic toxicity > 10 ppm and < 100 ppm[2] | AND chronic aquatic toxicity > 1 ppm | And biodegradation occurs within a 10-day window without degradation products of concern | AND BCF/BAF[3] < 1,000 |
| 2 | If acute aquatic toxicity ≥ 100 ppm | AND chronic aquatic toxicity ≥ 10 ppm | And biodegradation occurs within 28 days without degradation products of concern | AND BCF/BAF < 1,000 |

[1]LOEC—lowest observed effect concentration
[2]ppm—parts per million
[3]BCF—bioconcentration factor and BAF—bioaccumulation factor In one embodiment, the cleaning solution is a clear solution with a pH range of greater than or equal to 2 to less than or equal to 11.5 with a preferred pH range of greater than or equal to 2 to less than or equal to 3. In such an embodiment, the ingredients that may be used to make-up the cleaning solution include highly purified or deionized water; a thickener, such as a methyl cellulose, a hydroxylethyl cellulose, gums, gelatins, and carrageenans; hydrogen peroxide ($H_2O_2$); a surfactant component, such as alkylpolyglucoside and/or a 1-octanesulfonic acid sodium salt; and a pH adjuster, such as potassium, sodium salts, or a sodium metasilicate. In such an embodiment, none of the ingredients are acids such that this embodiment of the cleaning solution is a non-acid cleaning solution. Such an embodiment will also act as a stain remover that is capable of cleaning and acting as a stain remover. For instance, such embodiment may be used to remove stains commonly found on the hulls of various marine vessels.

In a preferred embodiment, the water utilized is highly purified or deionized water that has ions normally found in water, such as $Na^+$, $Ca^{2+}$, $Fe^{2+}$, and $Cu^{2+}$, and the like removed from the water. Use of such highly purified or deionized water is beneficial and improves the performance of the cleaning solution. The thickener is utilized to thicken the cleaning solution and to add some viscosity to the cleaning solution so that the cleaning solution will have more surface contact than typical water-thin solutions. One advantage of utilizing the thickener as an ingredient is that as the cleaning solution is applied to a surface for cleaning, the cleaning solution will stick to the surface and slowly move on the surface to increase the time that the cleaning solution is on the surface to increase the overall effectiveness of the cleaning solution.

Hydrogen peroxide ($H_2O_2$) is beneficial as it acts as an oxidizer and bleaching agent and will function to improve the cleaning ability of the cleaning solution and can easily remove stains. However, the pH of Hydrogen peroxide ($H_2O_2$) is too low to meet various restrictions imposed by various governing authorities, such as the EPA, for direct release products. Thus, in embodiments of the present invention, various ingredients will be mixed with the Hydrogen peroxide ($H_2O_2$) to increase the pH to meet various standards, including the EPA's direct release standards and guidelines for direct release products.

The surfactant component, such as alkyl polyglucoside, is beneficial to the cleaning solution in that it acts as a detergent and ultimately increases the ability of the present invention to clean the items and surfaces upon which the cleaning solution is sprayed or applied. One preferred alkyl polyglucoside is a $C_8$-$C_{10}$ alkyl polyglucoside that is a mild, nonionic product with increased detergency and wetting properties. Another preferred surfactant is a 1-octanesulfonic acid sodium salt which also acts as a detergent which will increase the ability of the cleaning solution to clean items upon which it is applied. In addition, these surfactants are beneficial to the cleaning solution as these surfactants will assist in reducing surface tension which will allow the various chemicals/ingredients in the cleaning solution to penetrate the surfaces. Such penetration will ultimately increase the effectiveness of the cleaning solution by increasing the ability of the cleaning solution to act as a cleaner and stain remover of various soiled surfaces upon which the cleaning solution is applied. For instance, with the cleaning solution applied to the hull of a boat, the surfactants enable the cleaning solution to penetrate stained boat hulls which will enable the cleaning solution to better clean and effectively reduce stains of the boat hull. The cleaning solution will also penetrate other surfaces once it is applied for cleaning.

The pH adjuster functions to adjust the pH of the various ingredients when mixed together to achieve a desired pH range of greater than or equal to 2 to less than or equal to 11.5 with a preferred pH range of greater than or equal to 2 to less than or equal to 3. In one embodiment, the quantity of pH adjuster utilized in the cleaning solution is the amount required to achieve the preferred pH range of greater than or equal to 2 to less than or equal to 3. In a preferred embodiment of the present invention, the preferred pH adjuster is sodium metasilicate at a percent weight range of 0.01-0.99%. The sodium metasilicate is also advantageous as it acts as a chelating agent and softens water in the cleaning solution and will also act to increase the pH so that the cleaning solution can achieve the preferred pH range. In addition, the sodium metasilicate can increase the alkalinity of the solution and assist in reducing tension and also assist in improving the cleaning performance of the solution.

In a preferred embodiment, the cleaning solution may be made up of the following: highly purified or deionized water at a percent weight range of 50-80%; xanthan gum at a percent weight of 0.01-0.5%; hydrogen peroxide at a percent weight range of 3-8%; sodium metasilicate at a percent weight range of 0.01-0.99%; and a surfactant component. In one embodiment, the surfactant component may be a $C_8$-$C_{10}$ alkyl polyglucoside at a percent weight range of 1-8%. In another embodiment, the surfactant component may be both a 1-octanesulfonic acid sodium salt at a percent weight range of 1-6% and a $C_8$-$C_{10}$ alkyl polyglucoside at a percent weight range of 1-8%.

FIG. 1 is a flowchart illustrating an overview flow of the steps implemented to manufacture the cleaning solution according to one embodiment of the present invention. In particular, flow 100 represents a method in one embodiment of the present invention for manufacturing the cleaning solution utilizing preferred ingredients. In block 110, a thickener is hydrated or mixed with highly purified or deionized water in a tank or other suitable container until the thickener is dissolved in the highly purified or deionized water and a first solution is created. The thickener may be dissolved by mixing the materials in a container until the thickener is completely dissolved in the highly purified or deionized water. In one embodiment, the container may be a stainless steel tank or other suitable container with a motorized mixer, such as a top entry motorized mixer with any number of impellers utilized for mixing the various components of the cleaning solution. In alternative embodiments, the ingredients/components of the cleaning solution may be hand mixed with any number of items, such as a paddle, impeller, or the like.

This first solution created after the thickener is dissolved in highly purified or deionized water is a mixture of water and the thickener. A key component of this first step 110 is the selection of the thickener to be hydrated or dissolved in highly purified or deionized water. In one embodiment of the present invention, the thickener that is selected and dissolved in water is xanthan gum. An appropriate quantity of xanthan gum is selected and added to maintain a percent weight range of 0.01-0.5%. After the preferred thickener is hydrated and dissolved in highly purified or deionized water and the first solution of highly purified or deionized water and thickener is created, flow 100 proceeds out of block 110 and then to block 120.

In block 120, hydrogen peroxide is added to the first solution of highly purified or deionized water and thickener. An appropriate quantity of hydrogen peroxide is selected and added to maintain a percent weight range of 3-8%. After block 120, flow 100 proceeds out of block 120 to block 130. In block 130, a surfactant component is then added. In one embodiment, only one surfactant is added to the first solution of highly purified or deionized water and thickener. A key component of this step in block 130 is the selection of a surfactant component to be added. In one embodiment of the present invention, the surfactant component is $C_8$-$C_{10}$ alkyl polyglucoside whereby an appropriate quantity is selected and added to maintain a percent weight range of 1-8%. In an alternative embodiment, the surfactant component may include two surfactants. In such an embodiment, in block 130 two surfactants would be selected and added. Thus, a first surfactant, such as is $C_8$-$C_{10}$ alkyl polyglucoside whereby an appropriate quantity is selected and added to maintain a percent weight range of 1-8%, is selected and added. After this first surfactant is added, a second surfactant is then selected and added which is preferably 1-octanesulfonic acid sodium salt whereby an appropriate quantity is selected and added to maintain a percent weight range of 1-6%. The present invention is not limited to the selection and addition of $C_8$-$C_{10}$ alkyl polyglucoside prior to another surfactant, such as 1-octanesulfonic acid sodium salt, as these ingredient may be added in any order in block 130. In some embodiments, these ingredients may be added at the same time. After block 130, flow 100 proceeds out of block 130 to block 140.

In block 140 a pH adjuster is then added. A key component of this step in block 140 is the selection of the pH adjuster to be added. In one embodiment of the present invention, the pH adjuster is sodium metasilicate whereby an appropriate quantity is selected and added to maintain a percent weight range of 0.01-0.99% and to ensure that the pH of the cleaning solution is in the range of greater than or equal to 2 to less than or equal to 3. After block 140, flow 100 proceeds out of block 140 to block 150.

In block 150, the ingredients are mixed together until a desired end product is obtained. In one embodiment, the ingredients may be mixed for ½ hour or for any length of time until a desired quality of the cleaning solution is obtained at the desired pH range of greater than or equal to 2 to less than or equal to 3. In one embodiment, as the ingredients are mixed, the pH of the cleaning solution may be checked to ensure that the pH meets the desired range. If upon testing the pH, a desired pH value is not achieved, then a user may add additional pH adjuster to the solution until the desired pH range is achieved.

While the desired pH range is greater than or equal to 2 to less than or equal to 3, this range may be altered in other embodiments of the present invention to maintain a pH range of greater than or equal to 2 to less than or equal to 11.5.

While FIG. 1 illustrates the addition of ingredients in a specific order as set forth in flow 100, the present invention is not limited to the addition of ingredients in the particular order illustrated in flow 100. In alternative embodiments, the ingredients may be added in different orders as long as the end product achieves the desired pH range and the desired and preferred percent weight ranges of the various ingredients of the cleaning solution.

In one embodiment, this cleaning solution containing hydrogen peroxide may be manufactured in a ready-to-use formulation. In alternative embodiments, this cleaning solution may be configured in a concentrated format whereby a user will have to add the concentrated cleaning solution to water before utilizing the cleaning solution. In such an embodiment, the concentrated format would preferably be housed in some type of package, container, or pod that will dissolve when mixed with or placed in water, such as a pod-type container or other similar housing.

In another embodiment of the present invention, the cleaning solution is a colored solution with a pH range of greater than or equal to 8 to less than or equal to 11.5 with a preferred pH range of greater than or equal to 11 to less than or equal to 11.5. In such an embodiment, the ingredients that may be used to make-up the cleaning solution include highly purified or deionized water, a thickener, a surfactant, a chelating agent, a dye, and citric acid.

In this embodiment, the water is preferably highly purified or deionized water at a percent weight range of 50-80%. The thickener is preferably xanthan gum at a percent weight range of 0.1-0.5%. One surfactant that may be used in this embodiment is a $C_8$-$C_{10}$ alkyl polyglucoside at a percent weight range of 20-35%.

The chelating agent is a methylglycinediacetic acid (MGDA) at a percent weight range 1-3%. In one embodiment, the chelating agent may be a trisodium salt of methylglycinediacetic acid ($Na_3MGDA$) at a percent weight range 1-3%. The chelating agent can control the concentration of metal ions in aqueous solutions and will increase the performance of the cleaning solution. The dye of the cleaning agent is at a preferred percent weight range of 0.001 to 0.003%. The dye is utilized in the present embodiment to add some color to the cleaning solution. In a preferred embodiment, the preferred color of the cleaning solution is blue so that the preferred dye is a direct blue 86 dye which may be a water soluble powder dye or may be water soluble liquid dye or other type of dye. In other embodiments, the cleaning solution may be any number of different colors, such as yellow, red, green and the like whereby any number of different dyes may be used, such as tartrazine, FD&C yellow no. 5 dye (highly purified form), acid yellow 23 dye, food yellow 3 dye, acid red 33 dye, acid red 14 dye, acid brown 14 dye, FD&C green no. 3 dye, methyl blue die, C.I. solvent green 7 dye, D&C green no. 8 dye, or food blue 1 dye, and the like.

The cleaning solution of this embodiment also includes citric acid at preferred weight range of 0.01-0.06%. The citric acid assists in adjusting the pH by lowering the pH of the mixture of previous ingredients to achieve the desired range. In addition, the citric acid can also assist in improving the cleaning power of the cleaning solution.

Figure 2:
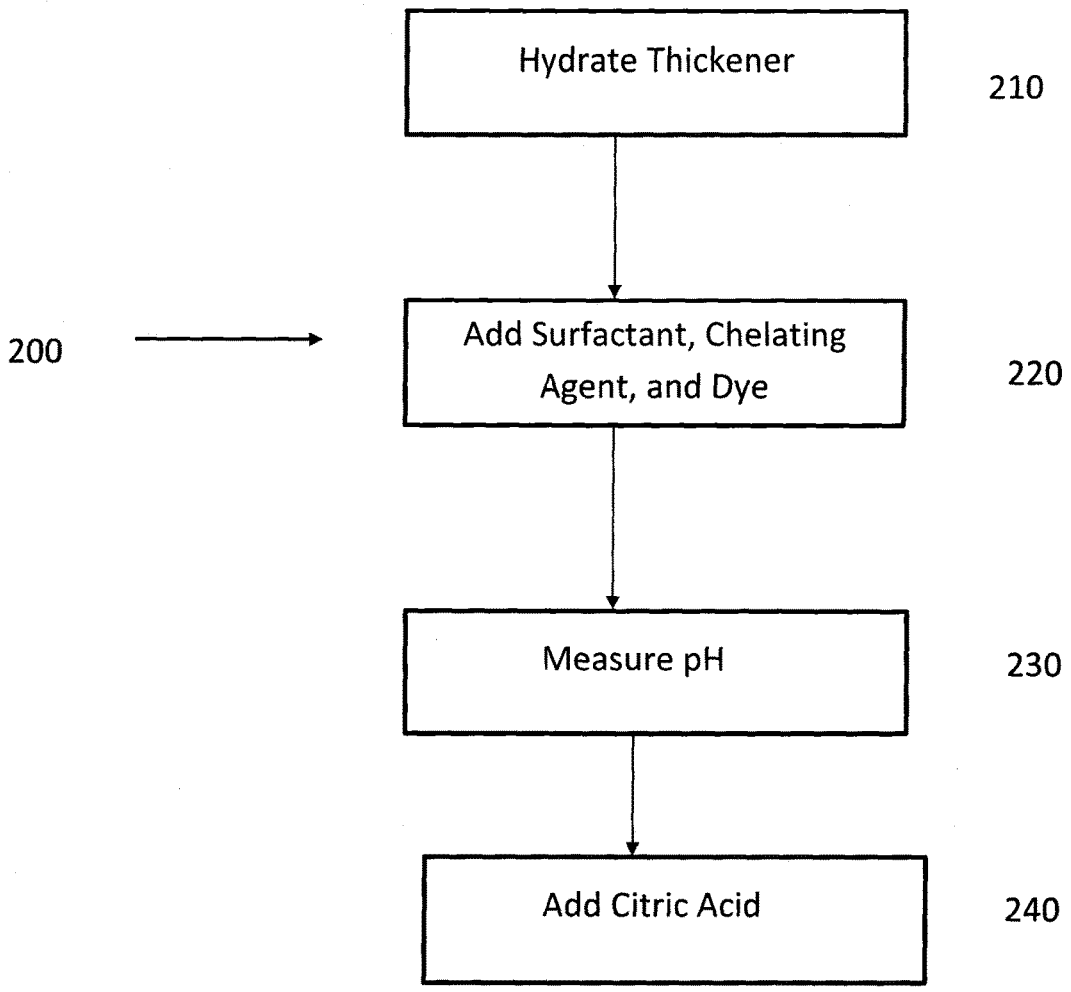
FIG. 2 is an illustration of a flowchart overview of a method of making a cleaning solution according to an alternative embodiment of the present invention.

FIG. 2 is a flowchart illustrating an overview flow of the steps implemented to manufacture the cleaning solution according to another embodiment of the present invention. In particular, flow 200 represents a method in one embodiment of the present invention for manufacturing the cleaning solution utilizing preferred ingredients. In block 210, a thickener is hydrated or mixed with highly purified or deionized water in a tank or other suitable container until the thickener is dissolved in the highly purified or deionized water with no visible lumps of thickener and a first solution of highly purified or deionized water and thickener is created. The thickener may be dissolved by mixing the materials in the container until the thickener is completely dissolved in the water. In one embodiment, the container may be a stainless steel tank or other suitable container with a motorized mixer, such as a top entry motorized mixer with any number of impellers utilized for mixing the various components of the cleaning solution. In alternative embodiments, the ingredients/components of the cleaning solution may be hand mixed with any number of items, such as a paddle, impeller, or the like.

This first solution of highly purified or deionized water and thickener created after the thickener is dissolved in water is a mixture of water and the thickener. A key component of this first step 210 is the selection of the thickener to be hydrated or dissolved in highly purified or deionized water. In one embodiment of the present invention, the thickener that is selected and dissolved in highly purified or deionized water is xanthan gum whereby an appropriate amount of xanthan gum is selected and added to maintain a percent weight range of 0.01-0.5%. After the preferred thickener is hydrated and dissolved in water and the first solution of water and thickener is created, flow 200 proceeds out of block 210 and then to block 220.

In block 220, the surfactant, chelating agent, and dye are added to the first solution of highly purified or deionized water and thickener and these ingredients may be mixed together. These ingredients may be added to the first solution of highly purified or deionized water and thickener in any particular order or these ingredients may all be added at the same time. A key component of this step in block 220 is the selection of the surfactant, the chelating agent, and the dye to be added to the first solution of highly purified or deionized water and thickener. In one embodiment of the present invention, the surfactant selected is a $C_8$-$C_{10}$ alkyl polyglucoside whereby an appropriate quantity is selected and added to maintain a percent weight range of 20-35%. A chelating agent is also selected whereby in one embodiment of the present invention, the chelating agent is methylglycinediacetic acid (MGDA) or a trisodium salt of methylglycinediacetic acid ($Na_3MGDA$) whereby an appropriate quantity is selected and added to maintain a percent weight range 1-3%. A dye is also selected whereby in one embodiment of the present invention, the preferred dye is a direct blue 86 dye whereby an appropriate quantity is selected and added to maintain a percent weight range of 0.001-0.003%.

After block 220, flow 200 proceeds out of block 220 to block 230. In block 230, the pH of all previously added and mixed ingredients is measured. After block 230, flow 200 proceeds out of block 230 to block 240.

In block 240, citric acid is added to all previous mixed ingredients and mixed with these ingredients to adjust the pH of the mixture of all previous ingredients. The pH is also monitored as citric acid is added to ensure that the desired pH is obtained. In this embodiment, citric acid is monitored while it is added so that an appropriate quantity is selected and added to maintain a percent weight range of 0.01-0.06% and obtain the preferred pH range of greater than or equal to 11 to less than or equal to 11.5.

In one embodiment, this embodiment of the cleaning solution containing citric acid may be manufactured in a ready-to-use formulation whereby the preferred make-up of the cleaning solution is highly purified or deionized water at a percent weight of 67.1482%; xanthan gum at a percent weight of 0.3%; $C_8$-$C_{10}$ alkyl polyglucoside at a percent weight of 30%; a chelating agent of methylglycinediacetic acid (MGDA) at a percent weight of 2.5%; dye at a percent weight of 0.0018%; and citric acid at a percent weight of 0.05%. In an alternative embodiment, the chelating agent is a trisodium salt of methylglycinediacetic acid ($Na_3MGDA$) at a percent weight of 2.5%.

In alternative embodiments, this particular formulation of the cleaning solution may be configured in a concentrated format whereby a user will utilize the same ingredients at different percent weight ranges to achieve a concentrated format whereby users will have to add the concentrated cleaning solution to water before utilizing the cleaning solution. In such an embodiment, the concentrated format would preferably be housed in some type of package, container, or pod that will dissolve when mixed with or placed in water, such as a pod-type container or other similar housing.

In another embodiment of the present invention, the cleaning solution is a solution with a pH range of greater than or equal to 10 to less than or equal to 11.5 with a preferred pH range of greater than or equal to 11 to less than or equal to 11.5. The preferred color of this embodiment may be a clear-hazy pale yellow. However, the present embodiment is not limited by this color as the present embodiment may be any number of colors. In such an embodiment, the ingredients that may be used to make-up the cleaning solution include highly purified or deionized water, a solvent, a surfactant, a chelating agent, a pH adjuster, and citric acid.

In this embodiment, the water is preferably highly purified or deionized water at a percent weight range of 50-80%. The solvent is preferably a diethylene glycol monobutyl ether $C_4H_9(OCH_2CH_2)_2OH$ at a percent weight range of 3-6%. In another embodiment, the solvent may be a diethylene glycol n-butyl ether $C_4H_9O[C_2H_4\ O]_2H$ at a percent weight range of 3-6%. The solvent is beneficial in cutting oil and grease so that when this embodiment is applied to surfaces that are stained with oil and/or grease the cleaning solution can "cut through" and clean up oil and/or grease stains. One surfactant that may be used in this embodiment is a $C_8$-$C_{10}$ alkyl polyglucoside at a percent weight range of 7-11%. This surfactant component is beneficial to the cleaning solution in that it acts as a detergent and ultimately increases the ability of the present invention to clean the items and surfaces upon which the cleaning solution is sprayed or applied. The preferred surfactant, a $C_8$-$C_{10}$ alkyl polyglucoside, is a mild, nonionic product with increased detergency and wetting properties.

The chelating agent may be a trisodium citrate at a percent weight range of 4-6%. The chelating agent can control the concentration of metal ions in aqueous solutions and will increase the performance of the cleaning solution. The cleaning solution also includes a pH adjuster that is sodium metasilicate at a percent weight range of 0.5-1.5%. The sodium metasilicate is advantageous as it will also act to increase the pH so that the cleaning solution can achieve the preferred pH range. In addition, the sodium metasilicate can increase the alkalinity of the solution and assist in reducing tension and also assist in improving the cleaning performance of the solution. The cleaning solution of this embodiment also includes citric acid at preferred weight range of 0.2-0.6%. The citric acid assists in improving the cleaning power of the cleaning solution. This embodiment of the present invention is configured so that the ingredients and this specific cleaning solution complies with the aquatic toxicity requirements set forth herein in the table above.

Figure 3:
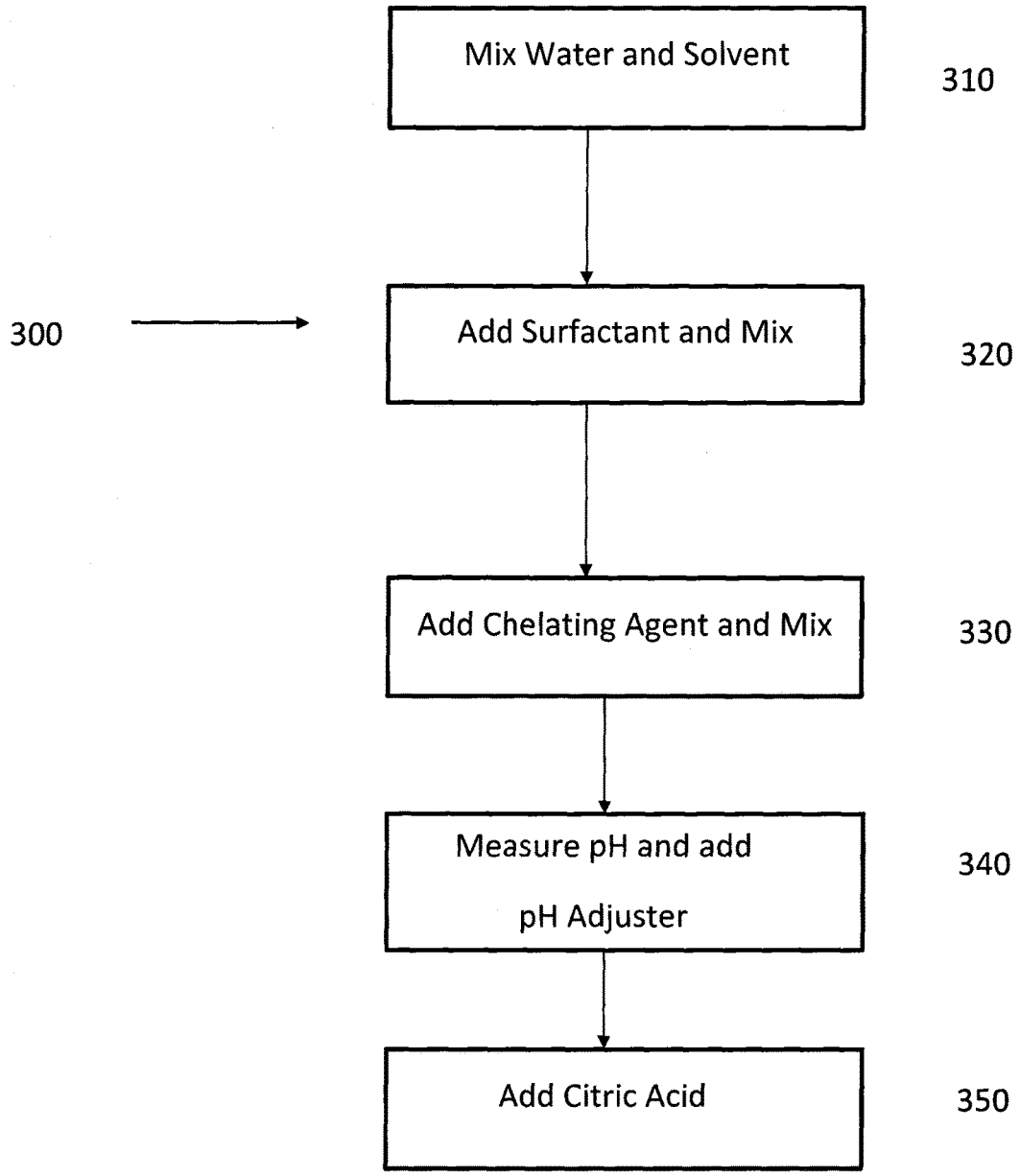
FIG. 3 is a flowchart illustrating an overview flow of the steps implemented to manufacture the cleaning solution according to another embodiment of the present invention.

FIG. 3 is a flowchart illustrating an overview flow of the steps implemented to manufacture the cleaning solution according to another embodiment of the present invention. In particular, flow 300 represents a method in one embodiment of the present invention for manufacturing the cleaning solution utilizing preferred ingredients. In block 310, the highly purified or deionized water is mixed with the solvent in a tank or other suitable container until the solvent is thoroughly mixed with the highly purified or deionized water. In one embodiment, the container may be a stainless steel tank or other suitable container with a motorized mixer, such as a top entry motorized mixer with any number of impellers utilized for mixing the various components of the cleaning solution. In alternative embodiments, the ingredients/components of the cleaning solution may be hand mixed with any number of items, such as a paddle, impeller, or the like.

A key component of this first step 310 is the selection of the solvent to be mixed with the highly purified or deionized water. In one embodiment of the present invention, the solvent that is selected and mixed in highly purified or deionized water is a diethylene glycol monobutyl ether $C_4H_9(OCH_2CH_2)_2OH$ whereby an appropriate amount of diethylene glycol monobutyl ether is selected and added to maintain a percent weight range of 3-6%. After the preferred solvent is mixed with water and the first solution of water and solvent is created, flow 300 proceeds out of block 310 and then to block 320.

In block 320, the surfactant is added to the first solution of highly purified or deionized water and solvent and these ingredients are thoroughly mixed together. A key component of this step in block 320 is the selection of the surfactant to be added to the first solution of highly purified or deionized water and solvent. In one embodiment of the present invention, the surfactant selected is a $C_8$-$C_{10}$ alkyl polyglucoside whereby an appropriate quantity is selected and added to maintain a percent weight range of 7-11%. After the preferred surfactant is mixed with water and the first solution of water and solvent, flow 300 proceeds out of block 320 and then to block 330. In block 330, the chelating agent is added to the previously mixed ingredients and the chelating agent is thoroughly mixed together with all previously mixed ingredients. A chelating agent is also selected whereby in one embodiment of the present invention, the chelating agent is trisodium citrate whereby an appropriate quantity is selected and added to maintain a percent weight range of 4-6%.

After block 330, flow 300 proceeds out of block 330 to block 340. In block 340, the pH of all previously added and mixed ingredients is measured. After the pH is measured, pH adjuster is added and mixed with all previous ingredients to achieve a desired pH. A key component of this step in block 340 is the selection of the pH adjuster to be added. In one embodiment of the present invention, the pH adjuster is sodium metasilicate whereby an appropriate quantity is selected and added to maintain a percent weight range of 0.5-1.5% and to ensure that the pH of the cleaning solution is in the range of greater than or equal to 11 to less than or equal to 11.5. After block 340, flow 300 proceeds out of block 340 to block 350.

In block 350, citric acid is added to all previous mixed ingredients and mixed with these ingredients. The pH is also monitored as citric acid is added to ensure that the desired pH is obtained. In this embodiment, citric acid is monitored while it is added so that an appropriate quantity is selected and added to maintain a percent weight range of 0.2-0.6% and maintain the preferred pH range of greater than or equal to 11 to less than or equal to 11.5.

In this embodiment of the cleaning solution containing citric acid, a solvent, and a surfactant, the cleaning solution may be manufactured in a ready-to-use formulation whereby the preferred make-up of the cleaning solution is highly purified or deionized water at a percent weight of 77.50%; a solvent component of diethylene glycol monobutyl ether $C_4H_9(OCH_2CH_2)_2OH$ at a percent weight of 6%, a surfactant component of $C_8$-$C_{10}$ alkyl polyglucoside at a percent weight of 10%; a chelating agent of trisodium citrate at a percent weight of 5%; a sodium metasilicate at a percent weight of 1%; and citric acid at a percent weight of 0.5%. In an alternative embodiment, the solvent component is a diethylene glycol n-butyl ether $C_4H_9O[C_2H_4\ O]_2H$ at a percent weight of 6%.

Although the present invention and its advantages have been described in detail, it should be understood that various changes, substitutions and alterations can be made herein without departing from the invention. Moreover, the scope of the present application is not intended to be limited to the particular embodiments of the process, machine, manufacture, composition of matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized.

What is claimed is:

1. A cleaning solution comprising:
deionized water;
about 0.01% wt. to 0.5% wt. thickener wherein said thickener is xanthan gum;
about 3% wt. to 8% wt. hydrogen peroxide (H2O2);
a surfactant, wherein said surfactant is a 1-octanesulfonic acid sodium salt at a percent weight range of 1-6% and a $C_8$-$C_{10}$ alkyl polyglucoside at a percent weight range of 1-8%; and
about 0.01% wt. to 0.99% wt pH adjuster wherein said pH adjuster is sodium metasilicate.

2. A cleaning solution comprising:
deionized water;
about 0.01% wt. to 0.5% wt. thickener wherein said thickener is xanthan gum;
about 3% wt. to 8% wt. hydrogen peroxide (H2O2);
a surfactant wherein said surfactant is a $C_8$-$C_{10}$ alkyl polyglucoside at a percent weight range of 1-8%; and
about 0.01% wt. to 0.99% wt pH adjuster wherein said pH adjuster is sodium metasilicate wherein said pH of said cleaning solution is in the range of 2 to 8.

3. A cleaning solution comprising:
deionized water;
about 0.1 to 0.5% wt. xanthan gum;
about 20 to 35% wt. $C_8$-$C_{10}$ alkyl polyglucoside;
a chelating agent wherein said chelating agent is a methylglycinediacetic acid (MGDA) of about 1 to 3% wt.; and
about 0.01 to 0.06% wt. citric acid.

4. A cleaning solution comprising:
deionized water;
about 0.1 to 0.5% wt. xanthan gum;
about 20 to 35% wt. $C_8$-$C_{10}$ alkyl polyglucoside;
a chelating agent wherein said chelating agent is a trisodium salt of methylglycinediacetic acid ($Na_3$MGDA) of about 1 to 3% wt.; and
about 0.01 to 0.06% wt. citric acid.

5. A cleaning solution comprising:
deionized water;
a solvent;
about 1 to 35% wt. $C_8$-$C_{10}$ alkyl polyglucoside;
a chelating agent;
about 0.5 to 1.5% wt. sodium metasilicate;
about 0.2 to 0.6% wt. citric acid; and
about 0.001 to 0.003% wt. dye.

6. A method for manufacturing a cleaning solution, wherein said cleaning solution complies with the EPA's Safer Choice direct release requirements, said method comprising:
providing purified water;
providing a solvent;
providing a surfactant, whereby said surfactant is a $C_8$-$C_{10}$ alkyl polyglucoside;
providing a chelating agent wherein said chelating agent is a trisodium citrate;
mixing said water and said solvent in a container to create a first mixture;
mixing said surfactant with said first mixture to create a second mixture;
mixing said chelating agent with said second mixture to create a third mixture comprised of said water, said solvent, said surfactant and said chelating agent;
measuring the pH of said third mixture;
providing a pH adjuster and mixing said pH adjuster with said third mixture to create a fourth mixture with a pH in the range of 11.0 to 11.5; and
providing citric acid and mixing said citric acid with said fourth mixture.

7. The method of claim 6 whereby said solvent is diethylene glycol monobutyl ether C4H9(OCH2CH2)2OH.

8. The method of claim 6 whereby said solvent is diethylene glycol n-butyl ether $C_4H_9O[C_2H_4O]_2H$.

9. The method of claim 6 whereby said pH adjuster is sodium metasilicate.

10. The cleaning solution of claim 3 further comprising: about 0.001 to 0.003% wt. dye.

11. The cleaning solution of claim 4 further comprising: about 0.001 to 0.003% wt. dye.

12. A method for manufacturing a cleaning solution, said method comprising:

providing purified water;

providing a thickener whereby said thickener is xanthan gum;

providing hydrogen peroxide (H2O2);

providing a surfactant, wherein said surfactant is a $C_8$-$C_{10}$ alkyl polyglucoside at a percent weight range of 1-8%; and providing about 0.01% wt. to 0.99% wt pH adjuster wherein said pH adjuster is sodium metasilicate;

mixing said water and said thickener in a container to create a first mixture;

mixing said hydrogen peroxide with said first mixture to create a second mixture;

mixing with said surfactant with said second mixture to create a third mixture comprised of said water, said thickener, said hydrogen peroxide, and said surfactant;

measuring the pH of said third mixture; and mixing said pH adjuster with said third mixture to create a fourth mixture with a pH in the range of 2 to 3.

13. A method for manufacturing a cleaning solution, said method comprising:

providing purified water;

providing a thickener whereby said thickener is xanthan gum;

providing a surfactant, wherein said surfactant is a $C_8$-$C_{10}$ alkyl polyglucoside at a percent weight range of 1-35%;

providing a chelating agent wherein said chelating agent is selected from the group consisting of a methylglycinediacetic acid (MGDA) of about 1 to 3% wt. and a trisodium salt of methylglycinediacetic acid ($Na_3$MGDA) of about 1 to 3% wt.;

providing a dye;

mixing said water and said thickener in a container to create a first mixture;

mixing said surfactant, said chelating agent, and said dye with said first mixture to create a second mixture;

measuring the pH of said second mixture; and providing citric acid and mixing said citric acid with said second mixture to create a third mixture with a pH range of 11 to 11.5.

* * * * *